United States Patent [19]

Davenport et al.

[11] 4,435,940

[45] Mar. 13, 1984

[54] METAL BUILDING TRUSS

[75] Inventors: Jeanne A. Davenport, Long Beach; Robert L. Campbell, Irvine; James F. Gallaway, Tustin, all of Calif.

[73] Assignee: Angeles Metal Trim Co., Los Angeles, Calif.

[21] Appl. No.: 376,527

[22] Filed: May 10, 1982

[51] Int. Cl.[3] ..... E04B 7/08

[52] U.S. Cl. ..... 52/641; 52/90; 52/639

[58] Field of Search ..... 52/639, 643, 690, 92, 52/693, 694, 90, 641

[56] References Cited

U.S. PATENT DOCUMENTS 559,335 4/1896 Kindl ..... 52/690

2,541,784 2/1951 Shannon ..... 52/90

*Primary Examiner*—John E. Murtagh

*Assistant Examiner*—Kathryn L. Ford

*Attorney, Agent, or Firm*—Harlan P. Huebner

[57] ABSTRACT

A light weight metal building truss preferably constructed of 20 gauge steel wherein there are a pair of top chord members and a bottom chord member. The top chord members and bottom chord members are united together at their respective ends forming a triangle. Extending between the top and bottom chord members are supports which are united therewith.

The top chord sections in cross section are generally hat shaped being an inverted U with flanges projected from the end of each leg of the U to effect stability of the completed truss.

7 Claims, 14 Drawing Figures

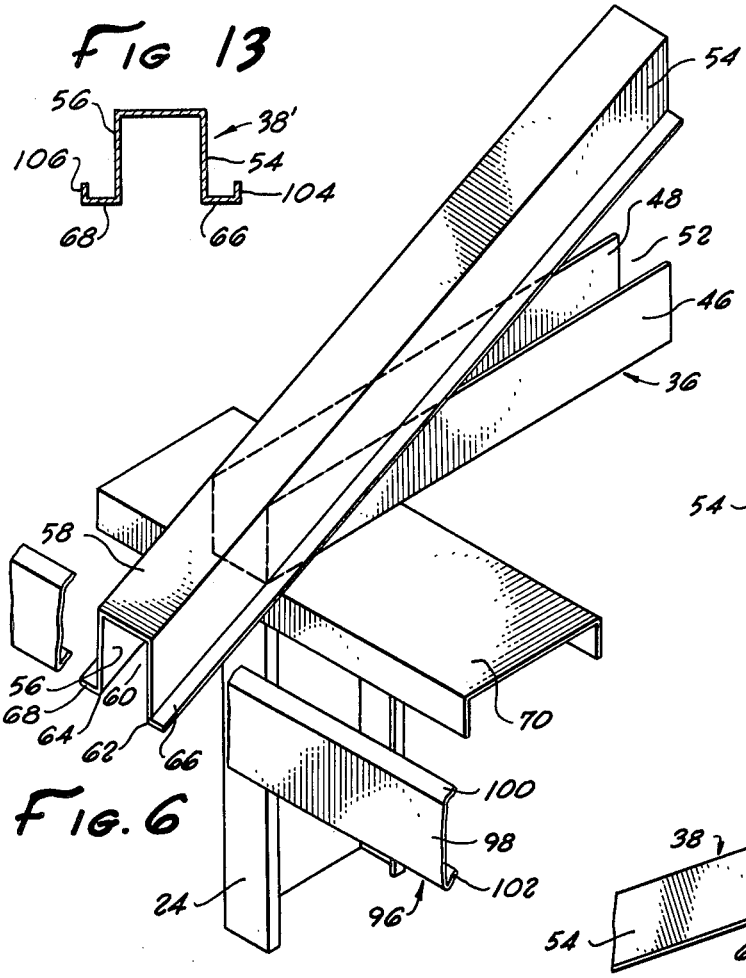
FIG. 6
FIG 13
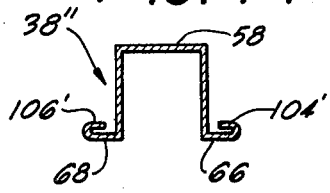
FIG. 14
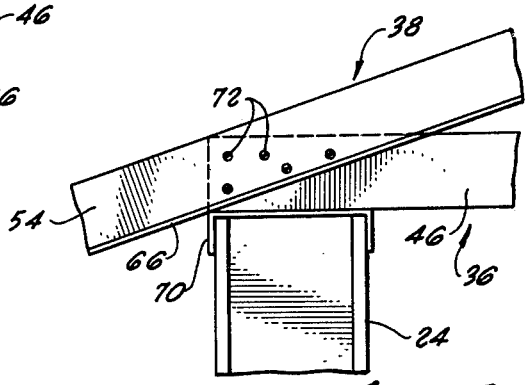
FIG. 7
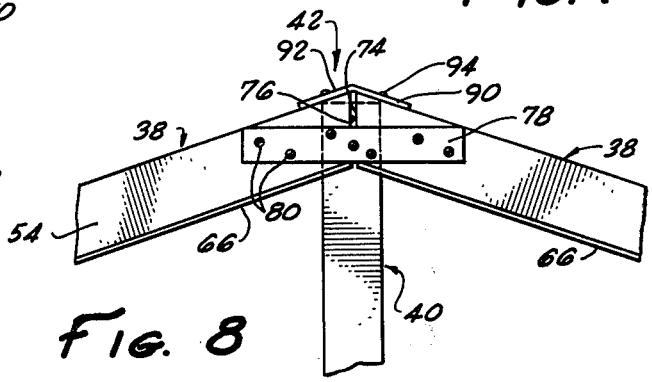
FIG. 8
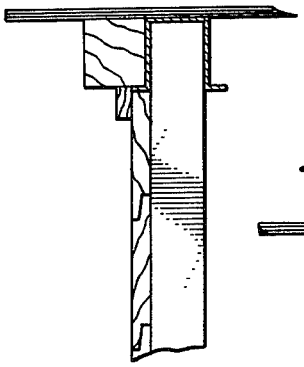
FIG. 11
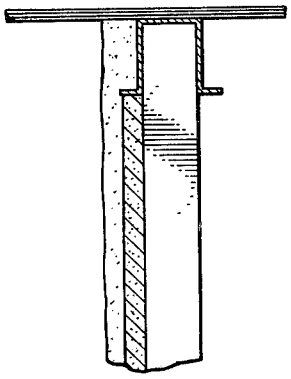
FIG. 12
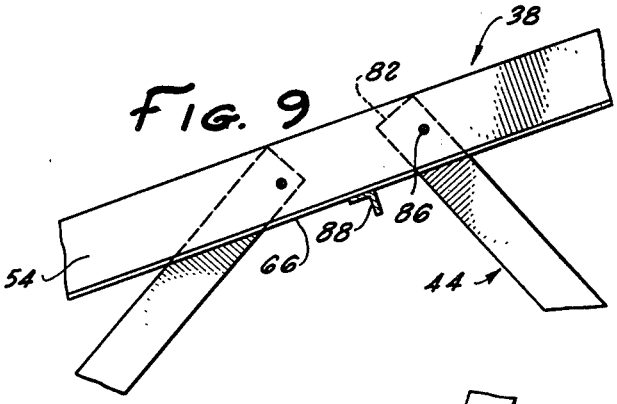
FIG. 9
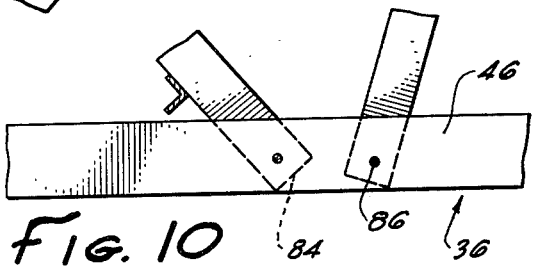
FIG. 10

METAL BUILDING TRUSS

BACKGROUND OF THE INVENTION

This invention relates to a lightweight unitary metal building truss.

Metal trusses for buildings have been in use but structurally they have been relatively heavy due to either the gauge of steel used and/or the number of fasteners needed to fasten the chords and diagonals. Further, the width of the steel studs used are on the magnitude of 3.625 inches with the bottom chord of the truss of a 4 inch width.

In addition the prior art includes wooden trusses which are of course even heavier than the prior art metal trusses.

As an illustration of the weight factors a 20 foot truss span which has a standard 4:12 pitch has a weight of approximately 115 lbs. The "4:12 pitch" refers to a standard in the industry that the truss rises 4 feet for every 12 feet of horizontal length of the truss to the center point. A 20 foot truss fabricated from metal with the same pitch posseses a weight of approximately 60 lbs. In addition the metal used has been that of 18 gauge steel. As used herein "18 gauge" means the thickness of the steel which is approximately 1.52 mm or 0.0478 inches. The steel referred to herein is hot dipped galvanized strip steel.

Other illustrations of approximate weight are as follows:

| | 28' Truss Span | 32' Truss Span |
|---|---|---|
| Prior Art Metal | 82 lbs. | 97 lbs. |
| Wood | 210 lbs. | 240 lbs. |

SUMMARY OF THE INVENTION

It has been found that with the development of a steel stud bearing the new cross-section of this invention the gauge of steel may be lessened and the weight thereof will be less than prior art trusses. It can be appreciated that the lighter the truss, while maintaining strength, the easier it is to move from the point of assembly to final installation.

The new metal truss of this invention can utilize 20 gauge steel, with studs of a width less than 1.75 inches. As used herein "20 gauge" means the thickness of steel which is approximately 0.9576 mm or 0.0377 inches. In addition, due to the configuration fewer fasteners are necessary to unite the parts.

It has been found that the new metal truss of the present invention when constructed in the lengths discussed above possessing the same pitch have the following approximate weight:

| 20' Truss Span | 28' Truss Span | 32' Truss Span |
|---|---|---|
| 46 lbs. | 67 lbs. | 82 lbs. |

As can be seen this is much less than conventional wood trusses and considerably less than metal trusses previously discussed:

It is an object of this invention to create the top or top chord members of a building truss having a cross section which is generally hat shaped. This particular shape will create an increase stiffening of the truss allowing for use of the lighter gauge of steel.

Another object of the invention is to provide steel material of one basic shape with various modifications which will further add to the strength factor of the truss.

A still further object of the invention is to provide the top chord pieces each having a cross sectional shape of an inverted U with flanges extending outward from the open legs of the U for added stiffening.

A further object of the invention is to provide a truss which may be prefabricated at the building site or at a factory and transported to the building site.

Another object of the invention is to form a metal building truss which is inexpensive.

Other objects and advantages will appear as the description of the disclosed preferred embodiments of the invention proceed.

BRIEF DESCRIPTION OF THE DRAWINGS

In the drawings which illustrate the presently preferred embodiments of the invention described in detail in the specification following:

FIG. 6 is a perspective view of the top chord section of the truss united with the bottom chord forming a base for the eaves of a building;

FIG. 7 is a detailed side elevational view illustrating the fastening of the top chord member to the bottom chord member;

FIG. 8 is a detailed side elevational view illustrating the fastening of the two top chords at the crown or ridge of the truss;

FIG. 9 is a detailed view illustrating the fastening of diagonal members to the top chord member;

FIG. 10 is a detailed view illustrating the fastening of the diagonal members of FIG. 9 to the bottom chord member;

FIG. 11 is a cross-sectional view illustrating one form of a building siding positioned with respect to the top chord member of the truss;

FIG. 12 is a view similar to FIG. 11 but with another form of siding namely plaster;

FIG. 13 is a cross-sectional view of modified top chord member; and

FIG. 14 is a view similar to FIG. 13 illustrating a still further modified top chord member.

DETAILED DESCRIPTION OF THE PREFERRED EMBODIMENTS

Figure 1:
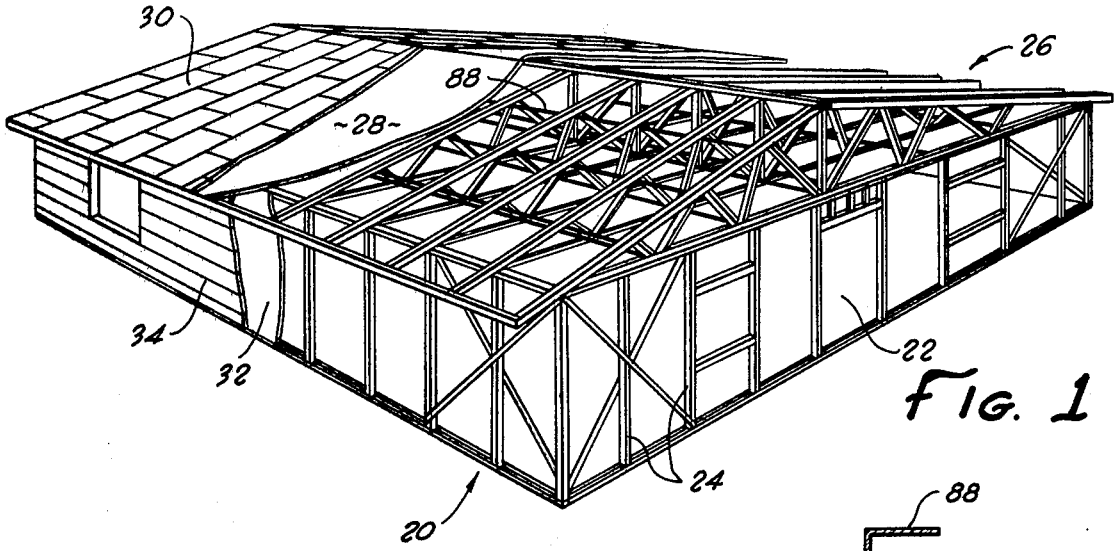
FIG. 1 is an environmental view illustrating a number of metal building trusses of this invention in position on the vertical frame walls of a building.

Referring to FIG. 1 there is illustrated a building structure generally designated 20 which is broken away to show details of general and specific construction.

There is a conventional floor 22 which may be laid on a foundation (not shown). Rising from the floor are conventional wood wall studs 24 or metallic wall sections such as defined and claimed in U.S. Pat. No. 4,235,054. Mounted on top of the wall studs 24 are the metal building trusses of this invention, each generally designated 26.

The building 20 may then have applied on top of the trusses 26 a conventional under roof 28 of the plywood, etc. over which may be laid a shingle or other outer roof 30. The wall studs 24 may be finished with rough wall material 32 and finished with any conventional outer wall material 34 such as a wall siding, plaster, etc.

Figure 2:
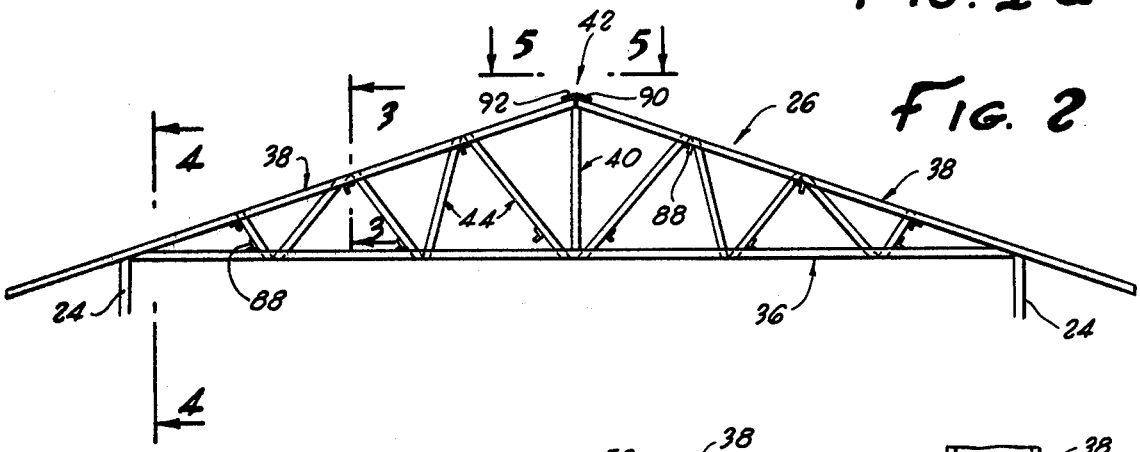
FIG. 2 is a side elevational view of a metal building truss of the present invention.
Figure 3:
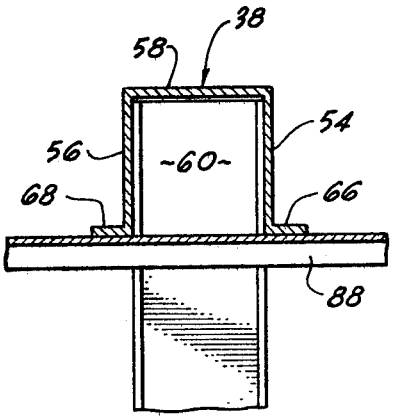
FIG. 3 is a cross-sectional view taken on line 3—3 of FIG. 2.
Figure 4:
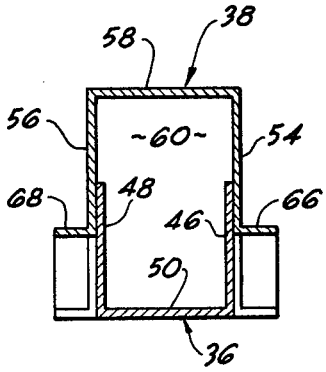
FIG. 4 is a cross-sectional view taken on line 4—4 of FIG. 2.
Figure 5:
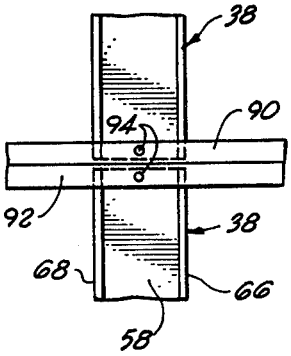
FIG. 5 is a cross-sectional view taken on line 5—5 of FIG. 2 looking down on the ridge cap of the truss.

Turning now to the truss 26 it is illustrated in one form in its entirety in FIG. 2. Generally in a building a plurality of the trusses 26 are set out across the building on anywhere from 16" to 24" centers. The sub or under roof material 28 is then laid thereon and fastened thereto.

The truss 26 generally includes a bottom chord member 36 and a pair of top or upper chord members 38. The respective members form a triangle with the bottom chord 36 as the base and the two top chords 38 forming the sides thereof. A standard such truss has what is commonly known as 4:12 pitch. The 4:12 pitch means that the top of the truss or top chord member 38 will rise from the exterior point of the bottom chord 36 to the center of an angle of 4 feet for every 12 feet to the center of the bottom chord.

Interfitted within the triangle above described may be a king post 40 depending on the span of the truss. The post 40 extends vertically between the bottom chord 36 and the crown 42 of the joined top chord member 38. In addition to the king post 40 there are a plurality of diagonal members 44 which extend between the bottom chord member 36 and the top chord members 38 at angles relative to the vertical king post 40.

In detail the bottom chord member 36 is preferably formed of 20 gauge steel and is U shaped in configuration, see FIG. 6. The member 36 includes a pair of spaced apart parallel side leg members 46 and 48 joined by a generally flat web or base 50 forming a channel 52 therebetween.

With regard to the top chord member 38 the configuration is also generally U shaped. In the case of the member 38 the U is inverted. The member includes a pair of spaced apart parallel side legs members 54 and 56 joined by a generally flat web 58. Formed between the leg members 54 and 56 and web 58 is a channel 60. The leg members 54 and 56 terminate at ends 62 and 64 and are each bent outward normal to the plane of the leg members 54 and 56 forming stiffing flanges 66 and 68. Again the chord members 38 are preferably formed from 20 gauge steel.

The king post 40 and diagonal members 44 are also preferably formed from 20 gauge steel and are generally C shaped in cross section, such as disclosed in U.S. Pat. No. 4,235,054. Therefore, the specific cross section of the diagonal members 44 have not been illustrated.

The assembly of the unitary truss 26 can be accomplished in a jig where the pieces are precut, laid in the jig and fastened together. In the alternative the truss 26 could be formed at the job site in a jig or not because with the preferred use of 20 gauge steel it may be cut with a hand held power saw or with metal shears.

Further, with the use of 20 gauge steel the fastening of the respective parts may be accomplished by means of metal screws which are conventionally driven through the metal members.

In order to assemble the truss 26 a piece of 20 gauge steel corresponding to the U shaped configuration of the bottom chord member 36 is cut to the appropriate length. Preferably the length will extend from the outside of one wall stud section 24. Preferably the bottom chord length does not exceed 32 feet or 960 cm. The bottom chord member 36 is positioned so that the base 50 will rest on the cap member 70 of the wall stud section 24. If the cap member 70 is metal, screws may be used to secure the truss 24 in place. In the alternative truss clips may be used to maintain the member 70 and box 50 together. If however the cap 70 is made from conventional wood a nail could be used to secure the bottom chord member 36 in place.

Next, the respective top chord hat shaped members 38 are secured in place. Each member 38 is fitted over the bottom chord member 36 so that the side legs 46 and 48 will interfit within the channel 60 and bear against the side of walls 54 and 56 of the top member 38. As best seen in FIG. 7, the pieces 36 and 38 are affixed together by means of screws 72 or they may be bonded together with adhesive or welded together. At the opposite end of bottom chord member 36 the same connection is made with the second top chord member 38.

The angle of the two top chord members 38 to the bottom chord member 36 is such as to form a triangle with a crown or apex 42 as best seen in FIG. 8. To affix the ends 74 and 76 together a ridge plate 78 of 20 gauge steel is places to stradle the butted ends 74 and 76 and is secured to the top members 38 by means of screws 80 or they may be bonded together with adhesive.

As can be seen in order to create eves the top chord members 38 extend beyond the ends of the bottom chord 36 and beyond the vertical wall stud sections 24.

In order to complete a truss 26 the number of diagonals 44 or the use of a king post 40 will depend on the overall length of the truss and whether between its ends it will be supported by interior wall structures. For sake of illustration in FIGS. 1, 2 and 8 there is illustrated a king post 40 extending vertically from the bottom chord member 36 to the apex or crown 42 of the respective top chord members 38.

The cross-sectional shape of the king post 40 and diagonals 44 is preferably a C, such as the member 24, see FIG. 6. The diagonals 44 have upper ends 82 and lower ends 84 which are respectively mounted in the channel of the bottom chord members and top chord member respectively. The diagonals 44 extend between the side legs 46 and 48 and within the hat shaped or top chord section 38 between the side legs 54 and 56. In order to secure the members 44 and 36 or 38 together screws 86 are used or the respective parts may be fixed together by an adhesive. The cross-sectional shape of the diagonals 44 may also be a U without departing from the spirit of the invention.

In order to complete the superstructure of the roof 30 a plurality of trusses 26 are mounted on the exterior wall stud members 24 as best seen in FIG. 1. They are in parallel relation one with the other and spaced equidistant one from the other with the spacing generally by local building codes.

Figure 1A:
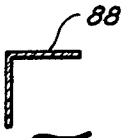
FIG. 1*a* is a cross-sectional view of a cross support member for tying several metal building trusses together.

To stabilize the respective trusses 26 in position a number of tie rods 88 are used. The rods 88 are preferably L shaped in cross section, see FIG. 1*a*, and extend between the trusses 26. A number of the tie rods 88 may be used spaced at various places on the truss and secured by screws (not shown) or other means.

Once all the trusses 26 are mounted on the wall structures and tied together a pair of elongated ridge caps 90 and 92 are laid on the web portion 58 of each of the top chord members 38 and butt together at the crown or apex 42. The caps 90 and 92 are secured to the top chord members 38 by screws 94 or adhesive means.

To finish the truss superstructure an elongated generally U shaped face plate 96 may be secured to the top chord members 38 at their exterior ends (see FIG. 6) at the edge of the eaves or building roof overlay section. The web 98 is of a width corresponding to the height of the top chord member 38 and at each side of the web, tabs 100 and 102 are bent normal to the plane of the web. In this way the tab 100 will overlie the web 58 of the chord member 38 so that it may be fastened thereto by a screw or other fastening means. In addition the tab 102 will underlie the stiffening flanges 66 and 68 of the chord 38 and may be united thereto with screws or other fastening means.

In FIGS. 13 and 14 there are illustrated two modified top chord members 38' and 38''. The basic structure is the same as the members 38 with the exception that additional strengthening metal bends are provided. In the case of the modifications of FIG. 13 the edges of the stiffening flanges 66 and 68 are bent upward parallel to the side legs 54 and 56 forming up turned edges 104 and 106.

With regard to the modification of FIG. 14 the up turned edges 104' and 106' of the stiffening flanges 66 and 68 are bent over on the flanges 66 and 68 respectively forming a double thickness flange.

While not illustrated it should also be recognized that additional stiffening of the hat shaped elongated top chord member 38 may be accomplished by forming elongated crimps along the length of either the side legs 54 and 56 or the web 58.

It should also be realized that the number of diagonal members 44 and their positioning with the truss may vary depending upon the area to be spanned. Further, in some cases with trusses spanning a 20 foot area the king post 40 may also be eliminated. In that case diagonal members 44 can extend upwardly and meet at the apex or crown 42 to effect the necessary structure to receive the static load of a complete roof 30.

Further, to assure that there is adequate strength in the truss 26 the bottom chord 36 where it joins the upper chord 38 may include a reinforcing plate (not shown) which is fastened by means of screws, rivets or welding.

The invention and its attendant advantages will be understood from the foregoing description and it will be apparent that various changes may be made in the form and method of making, construction and arrangements of the parts without departing from the spirit and scope thereof or sacrificing its material advantages, the arrangements herein before described being merely by way of example. We do not wish to be restricted to the specific forms shown, method, or uses mentioned, except as defined in the accompanying claims, wherein various portions have been separated for clarity of reading and not for emphasis.

We claim:

1. A unitary metal building truss of lightweight metal adapted to span an area defined by vertical walls having outer edges, said truss including bottom chord member resting upon said vertical walls and having ends extending to at least the outer edges of said vertical walls, a pair of top chord members each having an outer end and an inner end, each of said top chord members extending from at least the ends of said bottom chord member and secured thereto angled upward and inward toward each other and each inner end abutting the other and secured to each other forming a crown wherein the bottom and top chord members form a triangle, and a plurality of diagonal members extend between the bottom and top chord members and are secured thereto, wherein a plurality of said trusses are used to cover said area defined by said vertical walls the improvement including:

said bottom chord member being of lightweight material and having a generally U shaped cross section formed by a web and two legs extending from said web and said web forms a base with said legs projecting upwardly forming a channel;

said top chord members each being of lightweight metal and in cross section possessing a hat shaped configuration and of an interior dimension greater than the exterior width dimension of said bottom chord member to overlie and encompass a portion of the legs of the end of said bottom chord;

fastening means to directly secure the ends of said bottom chord to portions of said top chords and the abutting ends of said top chords;

diagonal members each being of lightweight metal having ends, and one end of said diagonal member adapting to interfit within the legs of said bottom chord member and extend upwardly at an angle to a vertical plane and the other end interfitted within the legs of one of said top chord members; and fastening means to secure the ends of said diagonal members to said bottom chord member and one of said top chord members.

2. A metal building truss as defined in claim 1 wherein said lightweight metal is 20 gauge galvanized steel.

3. A metal building truss as defined in claim 1 wherein the hat shaped configuration of said top chord members includes a top web of greater width than said bottom chord web separating a pair of parallel legs extending downwardly in the same direction from the web and at the ends of each leg strengthening flanges are bent outwardly in opposed directions one to the other and normal to the plane of said legs.

4. A metal building truss as defined in claim 3 wherein the bottom chord member at its end interfits within the space between the parallel legs of the top chord members whereby the legs of the bottom chord members directly engage the legs of the top chord member.

5. A metal building truss as defined in claim 1 wherein a single king post is provided of lightweight metal extending vertically between the bottom chord member and the crown formed by the top chord member and is generally C shaped in cross section.

6. A metal building truss as defined in claim 3 wherein the flanges are bent upon themselves forming strengthening ribs.

7. A metal building truss as defined in claim 1 wherein said diagonal members are generally C shaped in cross section.

* * * * *